United States Patent [19]

Miszewski et al.

[11] Patent Number: 5,033,553

[45] Date of Patent: Jul. 23, 1991

[54] INTRA-PERFORATING GUN SWIVEL

[75] Inventors: Antoni K. L. Miszewski; Klaus B. Huber, both of Missouri City, Tex.

[73] Assignee: Schlumberger Technology Corporation, Houston, Tex.

[21] Appl. No.: 509,642

[22] Filed: Apr. 12, 1990

[51] Int. Cl.[5] ..... E21B 43/116

[52] U.S. Cl. ..... 175/4.51; 175/4.6; 166/297

[58] Field of Search ..... 175/4.51, 4.6; 166/55, 166/297

[56] References Cited

U.S. PATENT DOCUMENTS 3,530,948 9/1970 Garrett ..... 175/4.51
4,194,577 3/1980 Vann ..... 175/4.51
4,523,649 6/1985 Stout ..... 175/4.51
4,768,597 9/1988 Lavigne et al. ..... 175/4.51

*Primary Examiner*—William P. Neuder
*Attorney, Agent, or Firm*—Henry N. Garrana; John H. Bouchard

[57] ABSTRACT

A perforating gun, adapted to be disposed in a deviated borehole, includes an intra-gun swivel located between a first plurality of charges and a second plurality of charges of the perforating gun. The swivel includes a first housing, a second housing, and thrust and radial bearings disposed between the surfaces of the first and second housing for allowing the first housing to rotate with respect to the second housing and therefore the first plurality of charges to rotate with respect to the second plurality of charges of the perforating gun.

12 Claims, 1 Drawing Sheet

INTRA-PERFORATING GUN SWIVEL

BACKGROUND OF THE INVENTION

The subject matter of the present invention relates to a swivel disposed in a perforating gun for enabling opposite parts of the perforating gun to independently swivel about an axis.

Perforating guns are sometimes disposed in deviated boreholes. When disposed in the deviated borehole, the perforating gun is rotated in order to direct the charges in a selected direction into the formation. Normally, a swivel located in the tubing string above the firing head of the perforating gun enables the perforating gun to rotate. However, since the swivel is located in the tubing string above the firing head of the gun, certain problems are created: (1) alignment error builds up in oriented guns, (2) torque builds up along the gun string, and (3) the swivel interferes with certain components above the gun string, such as hydraulic flow tubes, drop bars and slickline tools.

SUMMARY OF THE INVENTION

Accordingly, it is a primary object of the present invention to provide an intra-gun swivel for a perforating gun, the swivel being located within the perforating gun rather than above the perforating gun in the tubing string.

In accordance with this and other objects of the present invention, the intra-gun swivel of the present invention is disposed between a first part of the perforating gun and a second part of the perforating gun, the swivel including radial and annular thrust bearings interconnecting a first end of the swivel to a second end of the swivel. The first part of the perforating gun includes a plurality of charges interconnected by a detonating cord, a trigger shape charge being disposed at the end of the detonating cord for initiating detonation of a further detonating cord when the trigger charge detonates. The further detonating cord is disposed in the second part of the perforating gun and is connected to a further plurality of charges. Since the intra-gun swivel is located within the perforating gun string, and not above the perforating gun within the tubing string, alignment error built up in oriented guns can self correct. In addition, torque cannot build up along the perforating gun string; and the swivel does not interfere with any components above the perforating gun string, such as hydraulic flow tubes, drop bars, and slickline tools.

Further scope of applicability of the present invention will become apparent from the detailed description presented hereinafter. It should be understood, however, that the detailed description and the specific examples, while representing a preferred embodiment of the present invention, are given by way of illustration only, since various changes and modifications within the spirit and scope of the invention will become obvious to one skilled in the art from a reading of the following detailed description.

BRIEF DESCRIPTION OF THE DRAWINGS

A full understanding of the present invention will be obtained from the detailed description of the preferred embodiment presented hereinbelow, and the accompanying drawings, which are given by way of illustration only and are not intended to be limitative of the present invention, and wherein.

DETAILED DESCRIPTION OF THE PREFERRED EMBODIMENT

Figure 1:
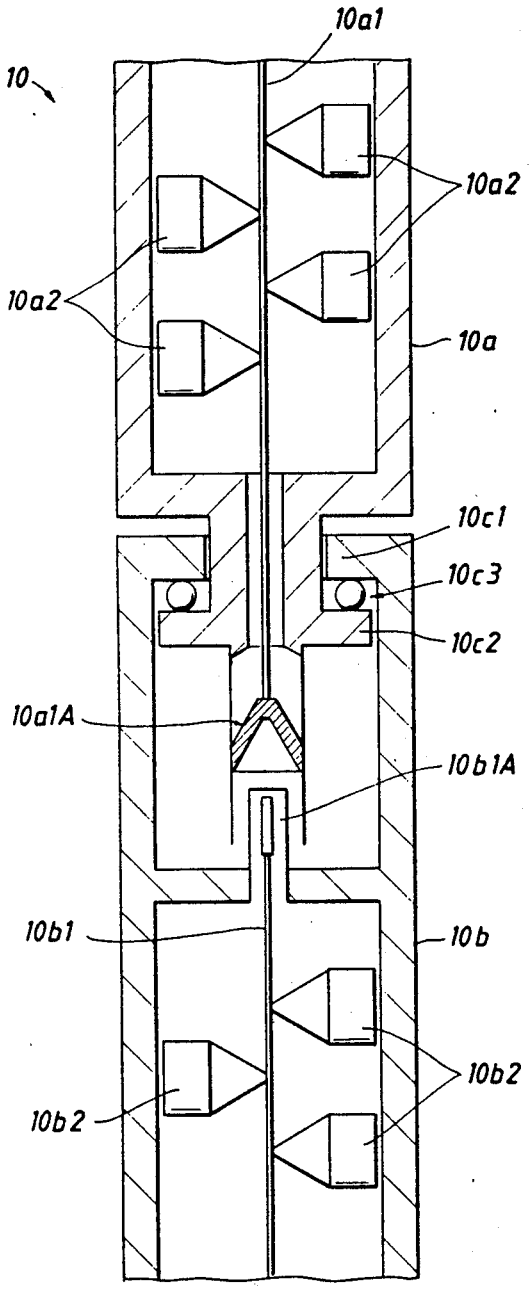
FIG. 1 illustrates the intra-gun swivel located within a perforating gun and separating the perforating gun into a first part and a second part.

Referring to FIG. 1, a perforating gun 10 includes a first part 10*a* and a second part 10*b*. A swivel 10*c* interconnects the first part 10*a* of the perforating gun to the second part 10*b* of the perforating gun. The swivel 10*c* includes, in the embodiment of invention shown in FIG. 1, an inwardly directed flange 10*c*1 connected to the second part 10*b* of the perforating gun, an outwardly directed flange 10*c*2 connected to the first part 10*a* of the perforating gun, and a thrust bearing 10*c*3 disposed between the inwardly directed flange 10*c*1 and the outwardly directed flange 10*c*2. A detonating cord 10*a*1 interconnects a plurality of charges 10*a*2 disposed within the first part 10*a* of the perforating gun. A further charge 10*a*1A is connected to the end of the detonating cord 10*a*1 below the swivel 10*c* for initiating detonation of a further detonating cord 10*b*1 disposed within the second part 10*b* of the perforating gun 10. The further detonating cord 10*b*1 interconnects a further plurality of charges 10*b*2 disposed within the second part 10*b* of the perforating gun. A booster 10*b*1A is disposed at the end of the further detonating cord 10*b*1 adjacent the further charge 10*a*1A for receiving a jet from the further charge 10*a*1A when the further charge 10*a*1A detonates and transferring a detonation wave to the further detonating cord 10*b*1.

Figure 2:
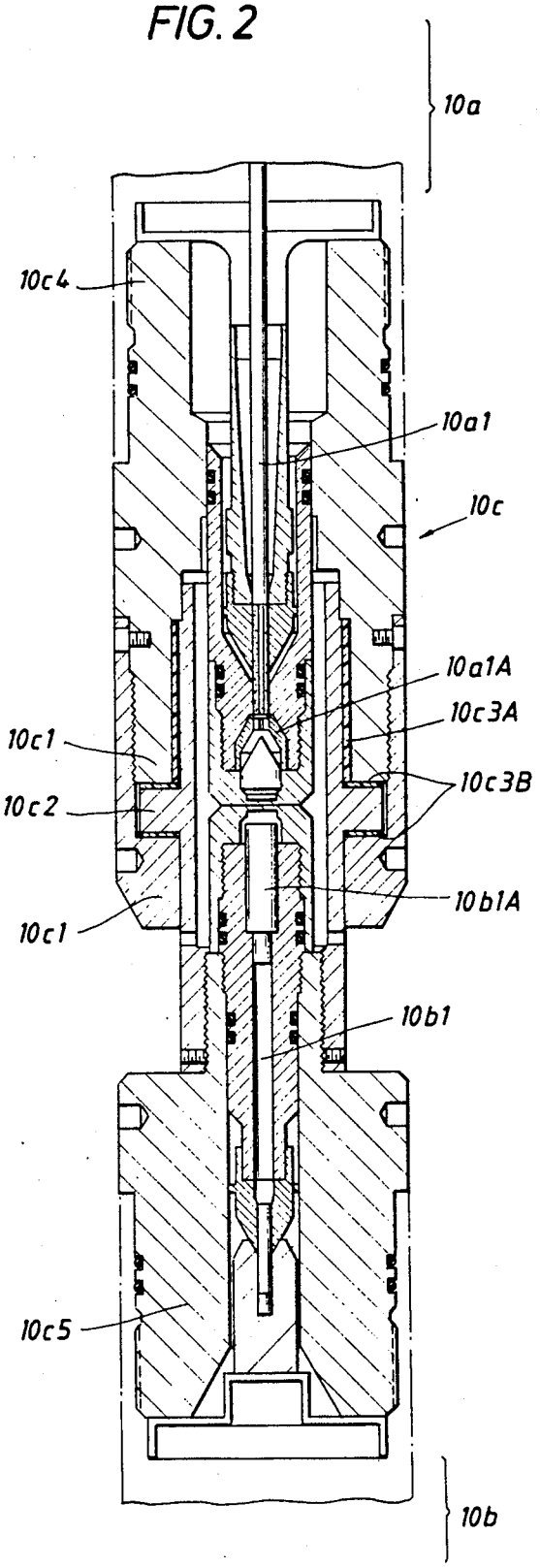
FIG. 2 illustrates a more detailed construction of the intragun swivel of FIG. 1.

Referring to FIG. 2, a more detailed construction of the intragun swivel 10*c* of FIG. 1 is illustrated.

FIG. 2 illustrates a more detailed construction of the swivel 10*c*, interconnected between the first part 10*a* and the second part 10*b* of the perforating gun 10, the swivel 10*c* in FIG. 2 comprising a first housing 10*c*4 including two inwardly directed flanges 10*c*1 and a second housing 10*c*5 connected to the first housing 10*c*4 and including an outwardly directed flange 10*c*2 which is disposed within a recess defined by the two inwardly directed flanges 10*c*1 of the first housing 10*c*4. A thrust bearing 10*c*3B is disposed on the upper and lower surfaces of the outwardly directed flange 10*c*2 and a radial bearing 10*c*3A is disposed between an outer wall surface of the second housing 10*c*5 and an inner wall surface of the first housing 10*c*4. A detonating cord 10*a*1 is connected to a further (trigger) charge 10*a*1A within the first housing 10*c*4 and a further detonating cord 10*b*1 is connected to a booster 10*b*1A within the second housing 10*c*5. The detonating cord 10*a*1 is connected to a first plurality of charges in the first part 10*a* of perforating gun 10 and the further detonating cord 10*b*1 is connected to a second plurality of charges in the second part 10*b* of the perforating gun 10. Due to the existence of the thrust bearing 10*c*3B and the radial bearing 10*c*3A between the first and second housings of the swivel, the first housing 10*c*4 may independently rotate with respect to the second housing 10*c*5.

A functional operation of the intragun swivel of the present invention will be set forth in the following paragraphs with reference to FIGS. 1 and 2 of the drawings.

In FIG. 1, as a result of the thrust bearing 10*c*3 disposed between the outwardly directed flange 10*c*2 of the first part 10*a* and the inwardly directed flange 10*c*1 of the second part 10*b*, the first part 10*a* of the perforating gun 10 is adapted to rotate with respect to the second part 10*b* of the perforating gun 10. When the first part 10*a* of perforating gun 10 is twisted or rotated with respect to the second part 10*b*, the bearing 10*c*3 rotates thereby allowing the inwardly directed flange 10*c*1 to move with respect to the outwardly directed flange 10*c*2. Since the plurality of charges 10*a*2 are disposed within the first part 10*a* of perforating gun 10, and the further plurality of charges 10*b*2 are disposed within the second part 10*b* of perforating gun 10, rotation of the first part 10*a* with respect to second part 10*b* enables the charges 10*a*2 in the first part to also rotate relative to the further charges 10*b*2 in the second part 10*b*. When it is desired to detonate the charges 10*a*2/10*b*2 in the perforating gun 10, a detonation wave is propagated along detonating cord 10*a*1 thereby detonating the plurality of charges 10*a*2 in the first part 10*a* of perforating gun 10. The further charge 10*a*1A detonates when the detonation wave is received therein. Detonation of the further charge 10*a*1A causes a further detonation wave to propagate from booster 10*b*1A along further detonating cord 10*b*1 to the further plurality of charges 10*b*2, initiating detonation of the further plurality of charges 10*b*2. Since the swivel 10*c* id disposed between the first part 10*a* and the second part 10*b* of the perforating gun 10, alignment error does not build up in the gun 10, torque does not build up within the perforating gun 10 string, and no interference is created with respect to the components in the tubing above the gun string.

In FIG. 2, when first housing 10*c*4 is rotated with respect to second housing 10*c*5, the thrust bearings 10*c*3B allow the outwardly directed flange 10*c*2 on the second housing 10*c*5 to move in its recess with respect to the two inwardly directed flanges 10*c*1 on the first housing 10*c*4. In addition, the radial bearing 10*c*3A allows the outer wall surface of the second housing 10*c*5 to move with respect to the inner wall surface of the first housing 10*c*4. In FIG. 2, when the detonation wave is received by the further (trigger) charge 10*a*1A from the detonating cord 10*a*1, the further charge 10*a*1A detonates thereby initiating the propagation of a further detonation wave in the further detonating cord 10*b*1 from booster 10*b*1A.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A perforating gun, comprising:

a first plurality of charges;

a second plurality of charges; and swivel means disposed between the first and second plurality of charges of the perforating gun for enabling the first plurality of charges to rotate about a longitudinal axis with respect to the second plurality of charges.

2. The perforating gun of claim 1, further comprising:

a first housing enclosing the first plurality of charges; and a second housing enclosing the second plurality of charges.

3. The perforating gun of claim 2, wherein said first housing and said second housing each include an end disposed adjacent one another; and wherein said swivel means comprises bearing means disposed between interfacing surfaces of the adjacent ends of said first housing and said second housing, the bearing means enabling said first housing including the first plurality of charges to rotate with respect to said second housing including said second plurality of charges.

4. The perforating gun of claim 3, wherein said first housing includes an outwardly directed flange, said second housing including an inwardly directed flange, said bearing means being disposed between the inwardly directed flange and the outwardly directed flange, the bearing means allowing the inwardly directed flange of said second housing to rotate with respect to the outwardly directed flange of said first housing.

5. The perforating gun of claim 4, further comprising:

a first detonating cord disposed within said first housing and interconnecting said first plurality of charges;

further trigger charge means disposed at an end of said first detonating cord for detonating in response to a detonation wave propagating along said first detonating cord;

a second detonating cord disposed within said second housing and interconnecting said second plurality of charges; and booster means disposed at an end of said second detonating cord and being further disposed adjacent said further trigger charge in said perforating gun for transmitting a detonation wave into said second detonating cord in response to detonation of said trigger charge.

6. A method of rotating a perforating gun when said gun is disposed in a borehole, said perforating gun including a swivel disposed between a first end and a second end of said gun, said first end including a first charge, said second end including a second charge, comprising:

twisting said first end of said perforating gun; and rotating said first end of said gun with respect to said second end of said gun, said swivel allowing said first end to rotate with respect to said second end.

7. The method of claim 6, wherein said swivel includes at least one bearing disposed between adjacent interfacing surfaces of said first end and said second end of said perforating gun, comprising the step of:

rotating said first end of said gun with respect to said second end, the bearing of said swivel allowing the adjacent interfacing surfaces of said first end and said second end of said perforating gun to move with respect to one another.

8. A perforating gun, comprising:

a first charge;

a second charge; and swivel means disposed between the first charge and the second charge for enabling the first charge to rotate about a longitudinal axis relative to said second charge.

9. The perforating gun of claim 8, further comprising:

a first housing enclosing the first charge; and a second housing enclosing the second charge.

10. The perforating gun of claim 9, wherein said first housing and said second housing each include an end disposed adjacent one another; and wherein said swivel means comprises bearing means disposed between interfacing surfaces of the adjacent ends of said first housing and said second housing, the bearing means enabling said first housing including the first charge to rotate with respect to said second housing including said second charge.

11. The perforating gun of claim 10, wherein said first housing includes an outwardly directed flange, said second housing including an inwardly directed flange, said bearing means being disposed between the inwardly directed flange and the outwardly directed flange, the bearing means allowing the inwardly directed flange of said second housing to rotate with respect to the outwardly directed flange of said first housing.

12. The perforating gun of claim 11, further comprising:

a first detonating cord disposed within said first housing and connected to said first charge;

further trigger charge means disposed at an end of said first detonating cord for detonating in response to a detonation wave propagating along said first detonating cord;

a second detonating cord disposed within said second housing and connected to said second charge; and booster means disposed at an end of said second detonating cord and being further disposed adjacent said further trigger charge in said perforating gun for transmitting a detonation wave into said second detonating cord in response to detonation of said trigger charge.

* * * * *